United States Patent [19]

Jamieson

[11] 3,980,180

[45] Sept. 14, 1976

[54] TRANSMISSIVE ARTICLE SORTING APPARATUS

[76] Inventor: John A. Jamieson, 5306 Kenwood Ave., Chevy Chase, Md. 20015

[22] Filed: Nov. 20, 1974

[21] Appl. No.: 525,660

[52] U.S. Cl. ..... 209/111.6; 209/73; 209/111.7 T; 250/223 R; 356/201

[51] Int. Cl.[2] ..... B07C 5/342

[58] Field of Search ..... 209/111.7, 111.6, 111.5, 209/73, 74; 250/223 R, 578; 356/195, 201, 173

[56] References Cited

UNITED STATES PATENTS

| | | | |
|---|---|---|---|
| 3,080,659 | 3/1963 | Wolford | 209/88 R X |
| 3,650,396 | 3/1972 | Gillespie et al. | 209/111.7 X |
| 3,773,172 | 11/1973 | McClure et al. | 209/73 |
| 3,776,381 | 12/1973 | Wood | 209/111.6 |
| 3,802,559 | 4/1974 | Luchetti | 209/111.7 |

*Primary Examiner*—Stanley H. Tollberg
*Attorney, Agent, or Firm*—O'Brien & Marks

[57] ABSTRACT

A sorter for reclaiming particles, such as glass particles, of a predetermined color or transmissivity utilizes a belt conveyor having a longitudinal row of openings over which particles are positioned for being conveyed past a light source and light sensor on opposite sides of the belt to sense the transmissivity, or color of the particles. Glass particles having a predetermined transmissivity are separated by suitable facilities, such as an air jet directed through the openings in the belt.

8 Claims, 13 Drawing Figures

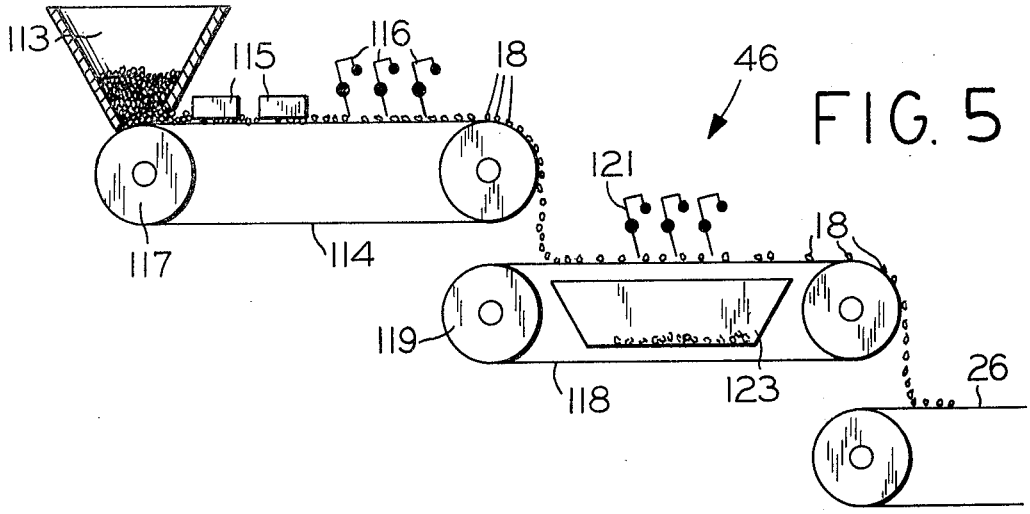
FIG. 5
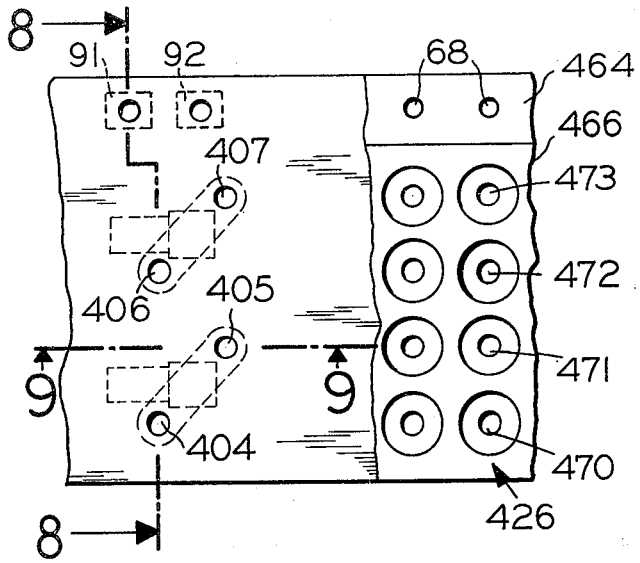
FIG. 7
FIG. 8
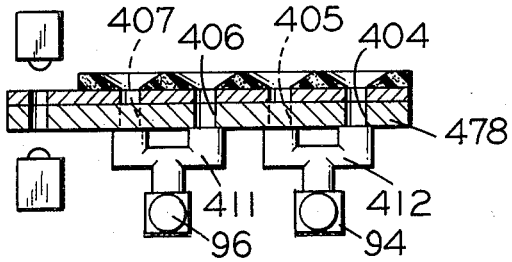
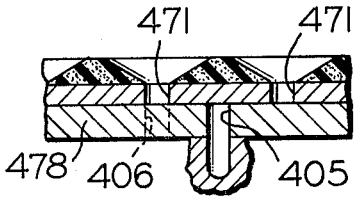
FIG. 9

MOTOR CONTROL
+V
-V
229
230
88
68
91
130
222
220
226
152
160
156
132
218
224
228
84
120
122
126
124
128
163
176
18
70
86
166
164
168
170
174
172
178
180
182
184
186
188
190
192
194
196
197
140
148
144
134
89
92
154
162
136
158
206
204
210
216
217
202
208
212
214
198
200
85
72
87
142
150
138
146
201

+V
250
254
262
270
249
291
252
266
274
248
258
268
290
230
260
264
256
-V
272
292
296
278
288
294
302
298
94
276
286
238
282
197
240
244
280
284
D P Q
S
Qc
C R
T1
236
304
300
242
310
217
306
308
246
314
312
201
96

TRANSMISSIVE ARTICLE SORTING APPARATUS

BACKGROUND OF THE INVENTION

1. Field of the Invention

The invention relates to apparatus for sorting articles according to their light transmissivity, and in particular, to apparatus for sorting articles, such as glass particles, of a particular color or colors from particles not having the particular color or transmissivity.

2. Description of the Prior Art

The prior art, as exemplified in U.S. Pat. Nos. 2,726,762; 2,821,302; 3,351,198; 3,435,950; 3,650,396 and 3,802,558, contains a number of apparatus for separating or sorting articles. Prior art apparatus have employed light beams and light sensors for detecting various transparent and colored subjects. Also, prior art apparatus have employed air jets for separating articles from a stream of articles. In the reclamation of glass, the glass articles are broken into small particles or cullet and the particles must be sorted as to their color; the prior art sorting apparatus was deficient in being incapable of economically sorting large quantities of cullet with a high degree of reliability.

SUMMARY OF THE INVENTION

The invention is summarized in that an apparatus for sorting articles according to transmissivity includes an opaque belt conveyor having a row of longitudinally spaced apertures, means for moving the belt conveyor, means for feeding the articles onto the belt conveyor such that each article is positioned over one of the apertures, a light source positioned on one side of the belt conveyor for directing a light beam through the apertures as they pass thereby, light sensing means positioned on the other side of the belt conveyor in alignment with the light source for sensing light passing through each aperture as each aperture passes between the light source and the light sensing means, and separating means operated in response to the light sensing means for separating articles transmitting a predetermined light from articles not transmitting the predetermined light.

An object of the invention is to construct an apparatus which can readily sort large quantities of articles of a predetermined transmissivity from articles of a different transmissivity.

Another object of the invention is to sense the color transmissivity of particles and to separate glass particles of a predetermined color transmissivity from particles having a different transmissivity.

It is also an object of the invention to employ apertures in an opaque belt conveyor for articles to determine the area of sensing the color transmissivity of articles placed on the belt conveyor.

An advantage of the invention is that apertures in a belt conveyor can be utilized both to seat particles and to provide windows for sensing light transmissivity of the particles and for directing an air jet to selected particles.

One feature of the invention is that a glass particle sorting apparatus is provided with a belt conveyor having a plurality of longitudinal rows of apertures wherein the particles are positioned over respective apertures in a first row of apertures, and apertures in a second row of apertures are positioned relative to the apertures in the first row to synchronize operation of sensing, memory, and separating functions.

Other objects, advantages and features of the invention will be apparent from the description of the preferred embodiment taken in conjunction with the accompanying drawings.

BRIEF DESCRIPTION OF THE DRAWINGS

FIG. 5 is a front view partly in cross section of a feeding mechanism of the apparatus shown in FIG. 1.

FIG. 7 is a plan view similar to FIG. 4 of a modified apparatus in accordance with the invention.

FIG. 8 is a side cross-sectional view taken along line 8—8 of FIG. 7.

FIG. 9 is a front cross-sectional view taken along line 9—9 of FIG. 7.

DESCRIPTION OF THE PREFERRED EMBODIMENT

Figure 1:
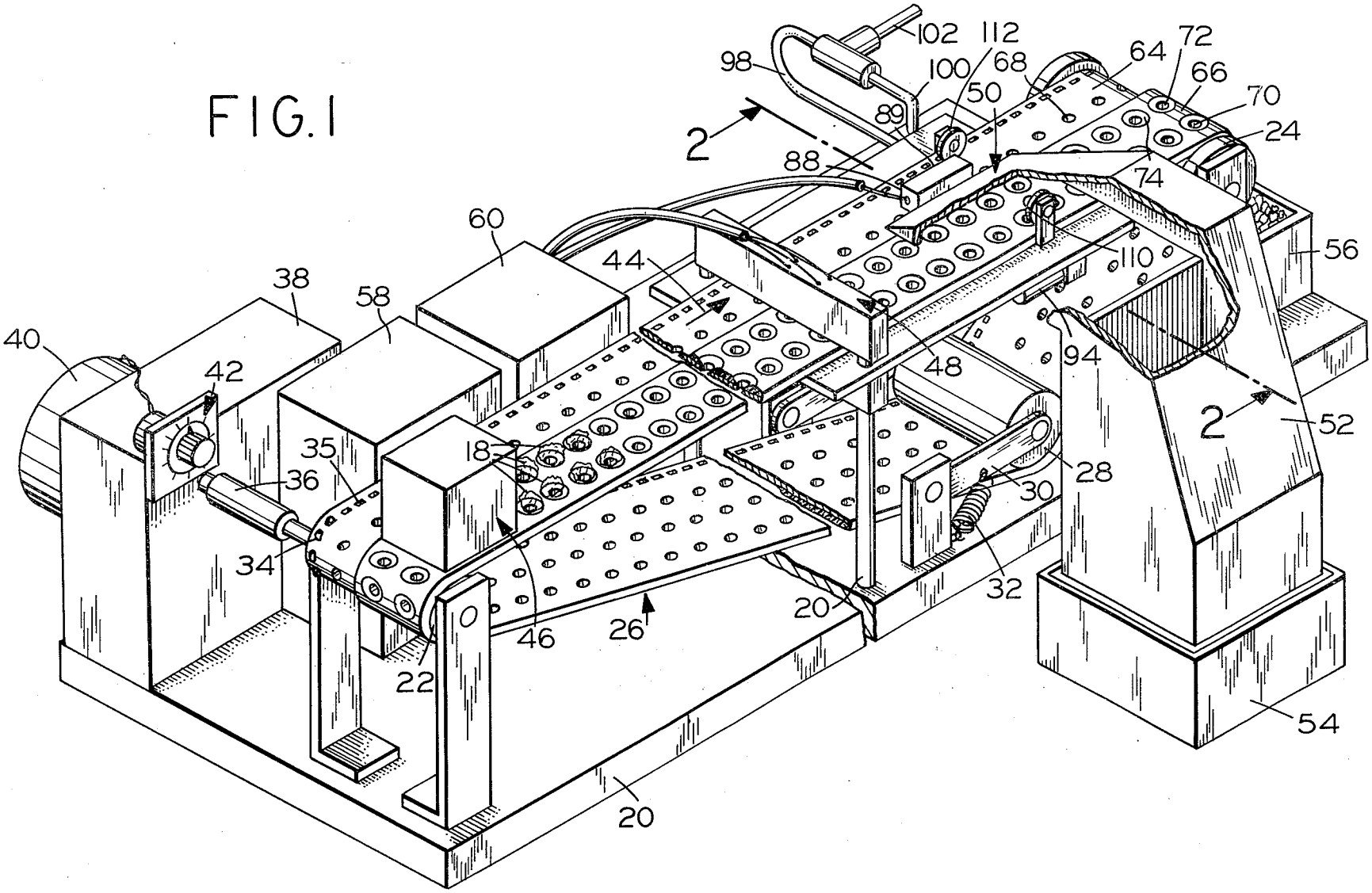
FIG. 1 is a perspective view of an apparatus for sorting glass particles in accordance with the invention.

As illustrated in FIG. 1, the invention is embodied in an apparatus for sorting articles or particles of a selected color transmissivity, such as clear irregular and jagged glass particles, from particles of a different transmissivity. The particles 18 to be sorted will previously have been shattered in a mill and separated from other refuse materials. The particles 18 may include glasses of different colors, such as clear glass and non-clear glass like amber glass, green glass, red glass, blue glass, etc., and various other solid materials of a similar density such as stones, ceramics, metal, and the like.

The apparatus includes a support or frame 20 upon which pulleys 22 and 24 are rotatively mounted. A belt conveyor indicated generally at 26 passes over the pulleys 22 and 24 and a tension roller 28 rotatively mounted on one ends of arms 30. Tension springs 32 between the frame 20 and intermediate points of the arms 30 urge the arms 30 about their other end which are pivotally mounted on the frame 20 to maintain the belt conveyor 26 under tension. The pulley 22 may be provided with sprocket teeth 34 for mating with sprocket holes 35 in one edge of the belt conveyor 26 and is driven by a drive shaft 36 from a gear box 38 connected to a motor 40 which is controlled by a motor speed control 42 to drive the conveyor 26 in the direction indicated by the arrow 44. The motor control 42 is the type having an "on" and an "off" position, as well as providing for a selected speed of the motor 40. The belt conveyor 26 at its left end as viewed in FIG. 1 is disposed beneath a particle feeding mechanism indicated generally at 46 and extends therefrom through a sensing station indicated generally at 48 and subsequently to a separating station indicated generally at 50. A particle receiving or guiding hood mechanism 52 extends over the station 50 for receiving particles, such as clear glass particles, from the separating station 50 and directing them over the side of the belt conveyor 26 to a suitable receptacle 54. A receptacle 56 is provided beneath the right end of the conveyor as shown in FIG. 1 for receiving particles which are not removed from the conveyor belt 26 at the separating station 50.

Figure 2:
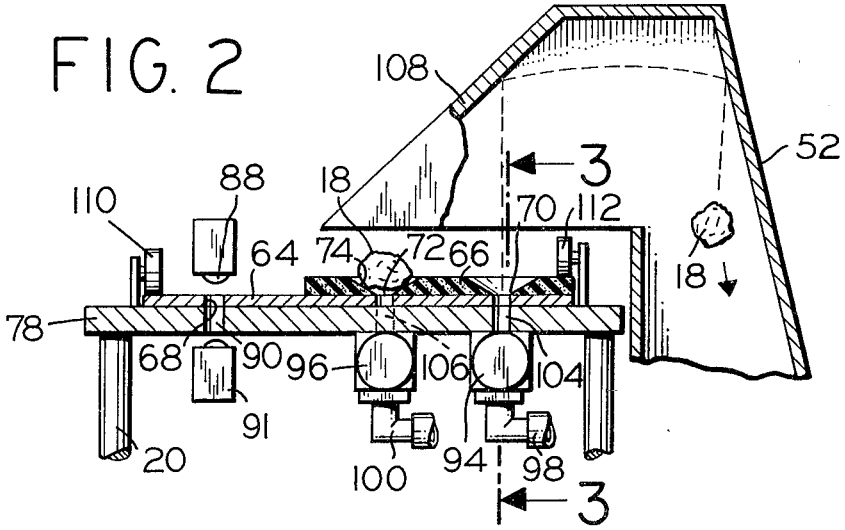
FIG. 2 is a partial side cross-sectional view taken in a vertical plane containing line 2—2 of FIG. 1.
Figure 3:
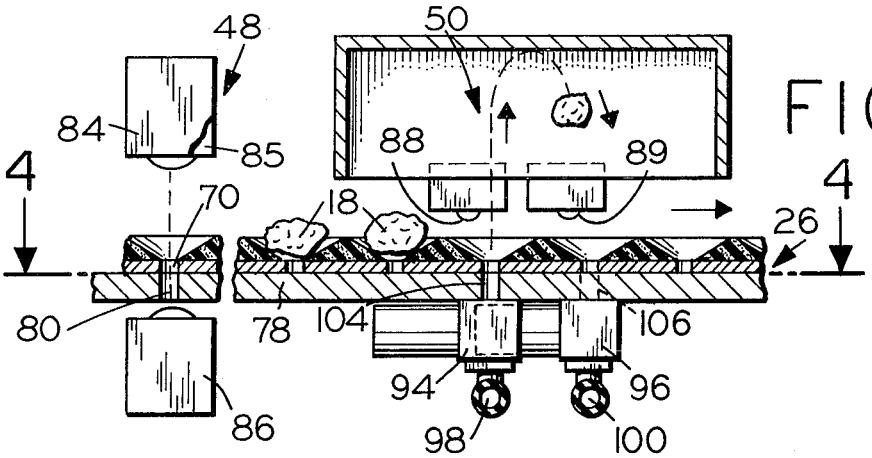
FIG. 3 is a partial front cross-sectional view with an intermediate portion removed taken along line 3—3 of FIG. 2.

As shown in FIGS. 1, 2, and 3, the belt conveyor 26 is formed from a flexible base strip 64, such as a steel strip, mylar strip, or the like, and a cover strip of a relatively resilient abrasion-resistant material, such as a vinyl, a closed cell foam rubber, or the like bonded to only a portion of the width of the base strip 64. A longitudinal row of apertures or holes 68 is formed in the strip 64 throughout the length of the belt conveyor 26 in the edge of the strip 64 which is not covered by the material 66. Rows of apertures or holes 70 and 72, respectively, extend parallel the row 68 and are formed through the base strip 64 and cover strip 66. The strip 66 has conical depressions or dimples 74 formed in the upper flat surface of the strip around the apertures 70 and 72. The strip 64 and the strip 66 are formed from suitable opaque materials or have opaque coatings thereon so that light impinging on the conveyor 26 can only pass through the apertures 68, 70 and 72. Preferably, the conveyor 26 or opaque coating thereon is black so that it absorbs substantially all light impinging thereon.

Figure 4:
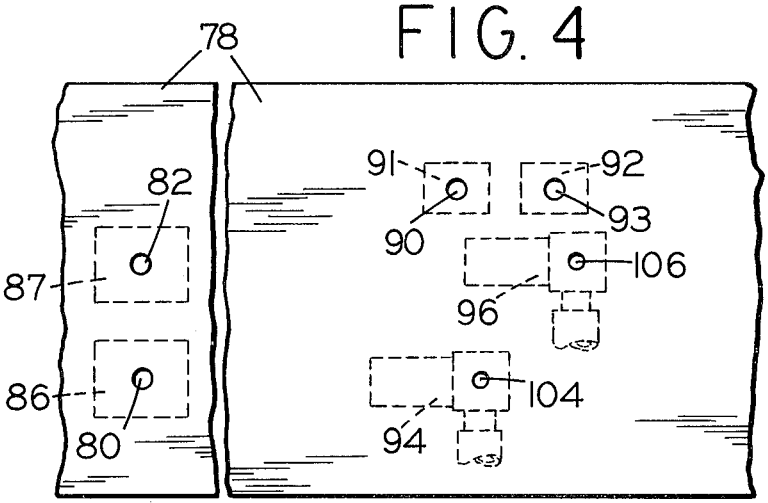
FIG. 4 is a partial top cross-sectional view taken along line 4—4 of FIG. 3.

A plate 78, mounted on the frame 20, extends beneath the belt conveyor 26 at the stations 48 and 50 as shown in FIGS. 2, 3 and 4. A pair of openings 80 and 82 are formed in the plate 78 at the station 48 for aligning with the respective rows of apertures 70 and 72. Light sources 84 and 85 are suitably supported above the respective openings 80 and 82 for directing light beams downward through the apertures 70 and 72 when they are aligned with the holes 80 and 82. Light sensing devices 86 and 87 are supported below the plate 78 in direct alignment with the respective openings 80 and 82 for sensing direct light passing through the apertures 70 and 72 and the openings 80 and 82.

At the separating station 50, light sources 88 and 89 are mounted in respective spaced positions aligned with the row of apertures 68 in the base strip 64 and aligned with respective openings 90 and 93 through the plate 78. Light sensing devices 91 and 92, aligned with the respective openings 90 and 93 are mounted below the plate 78 for sensing light passing through the openings 90 and 93 when aligned with an aperture 68.

Also, at the separating station 50, solenoid valves 94 and 96 have inputs connected to respective branches 98 and 100 from a pressurized air supply line 102, FIG. 1, and have outputs communicating with respective holes 104 and 106 aligned with the respective rows of apertures 70 and 72. The hood 52 has an inclined plate 108 extending over the openings 104 and 106 such that when jets of air from the openings 104 and 106 project particles upward from the apertures 70 and 72, the particles are deflected over the side of the conveyor belt and down into the receptacle 54. A pair of hold down rollers 110 and 112 are mounted on the plate 78 at opposite edges of the belt conveyor 26 at the station 50 for holding the belt conveyor 26 down against the plate 78 to prevent the air jets from lifting the belt conveyor 26 from the plate 78.

Electronic circuitry 60, FIG. 1, energized by a power supply 58 is electrically connected to the respective light sources 84, 85, 88 and 89, the light sensing devices 86, 87, 91 and 92 and the solenoid valves 94 and 96. The light sources 84 and 85 are preferrably relatively narrow bandwidth light sources which emit a selected frequency or spectrum of light and may be light emitting diodes, such as Fairchild 252 LED's. Also, preferrably sensing devices 86 and 87 are narrow bandwidth responsive devices and may be phototransistors such as a Fairchild FPT 120 which respond to a selected frequency or spectrum of light. The light sources 84 and 85 and/or the sensing devices 86 and 87 may also include color filter devices or the like to provide for a suitable response to the transmission of a selected color or absence of selected color transmission through a particle. The light sources 88 and 89 and the light sensing devices 91 and 92 are similarly any compatible light sources and light sensing devices such as model L31 light emitting diode and model L81 phototransistor, respectively, from Texas Instruments, Inc. Conveniently, the light sources 84, 85, 88 and 89 and the light sensing devices 86, 87, 91 and 92 have sealed enclosures with windows or lenses that can be readily cleaned periodically.

The feeding station 46, as illustrated in FIG. 5, has a hopper 113 for receiving the particles 18 to be sorted. The hopper 113 is positioned over one end of a belt conveyor 114 supported by pulleys 117 for discharging the particles 18 onto the conveyor 114 where they are scraped into a single layer by scraper blades 115. Prior to feeding into the hopper 113, the particles 18 are sieved to eliminate particles which have sizes not within a selected range of sizes. The blades 115 may also be utilized to scrape any oversize particles off the belt conveyor 114. Downstream of the blades 115, suitable gravity biased rakes 116 arrange the particles 18 into longitudinal rows; for example, two rows for the apparatus of FIG. 1. The rows of particles 18 are dropped from the right end, as viewed in FIG. 5, of the conveyor 114 onto a belt conveyor 118 supported over pulleys 119. The belt conveyor 118 has longitudinal rows of openings surrounded by dimples or seats similar to the rows of apertures 70 and 72 and dimples 74 of the belt conveyor 26, except that the longitudinal spacing between openings on the conveyor 118 is substantially greater, for example, about three times greater. Suitable rakes 121 guide the particles into the dimples or seats on the conveyor 118. The openings in the belt conveyor 118 are of a suitable size and the belt conveyor 118 may be vibrated so that particles which are too small fall into a receptacle 123 for disposal or other use. From the right end of the belt conveyor 118 the rows of particles 18 are dropped onto the conveyor 26. The conveyor 118 is timed, for example, by a corresponding higher speed drive from the gear box 38, FIG. 1, to deposit the particles 18 into the dimples 74 directly over the apertures 70 and 72.

Figure 6A:
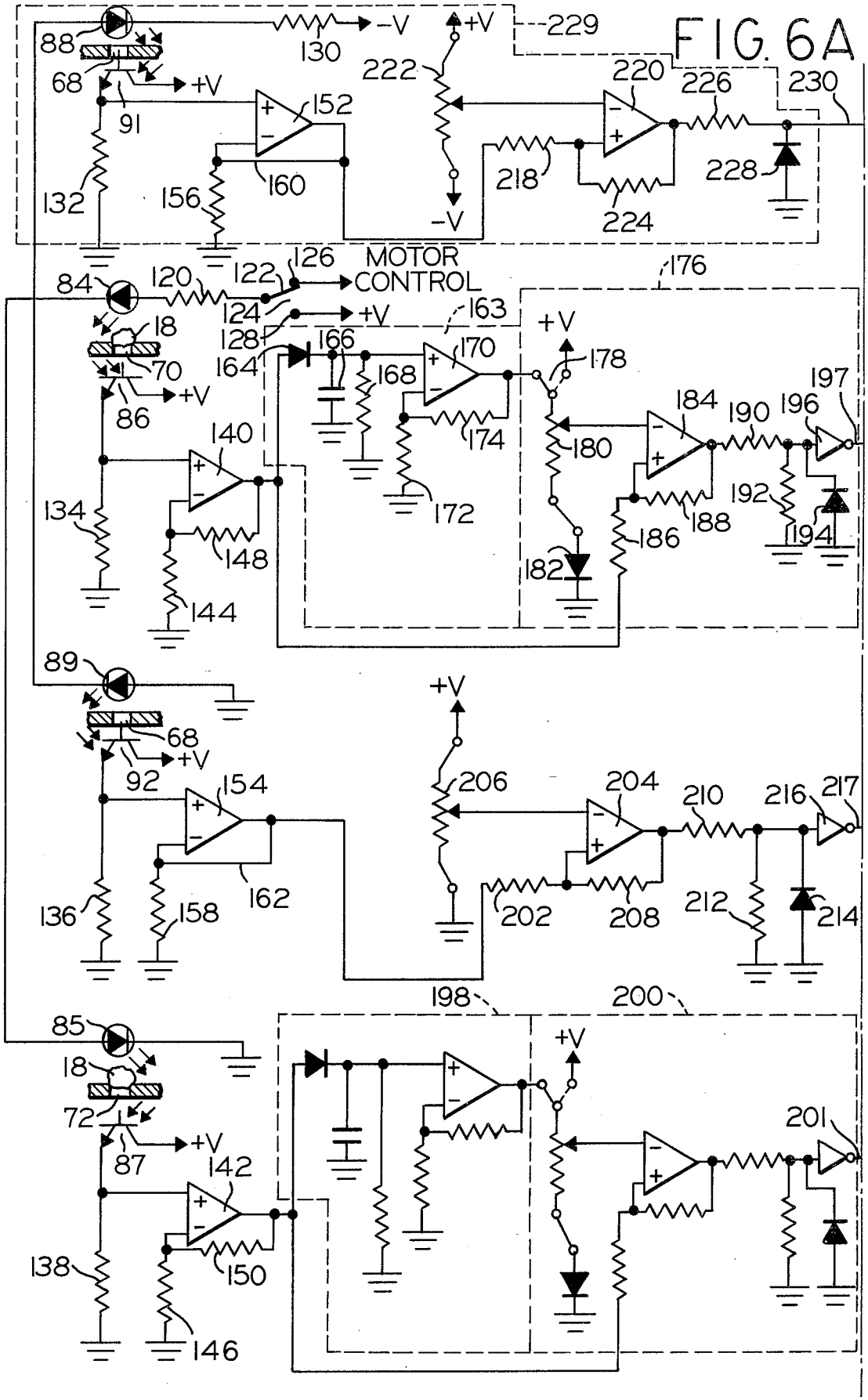
FIG. 6A is a left portion of an electrical circuit diagram of a control circuit for the apparatus of FIG. 1.

In the electronic circuit 60, illustrated in FIG. 6A, the light sources or light emitting diodes 84 and 85 are connected in series with a resistance 120 to the contact arm 122 of a single-pole double-throw switch 124. The contact arm 122 normally engages a contact 126 connected to a positive voltage supply when the motor control 42, FIG. 1, is in the on position. The normally open contact 128 of the switch 124 is connected to a voltage terminal +V from the power supply 58, FIG. 1. The light sources or light emitting diodes 88 and 89 are connected in series with a resistance 130 to a voltage terminal −V from the power supply 58. The light sensing devices or phototransistors 86, 87, 91 and 92 have their collector electrodes connected to the voltage terminal +V and have their emitter electrodes connected to in series with respective resistances 134, 138, 132 and 136 to ground or a common terminal. The positive inputs of operational amplifiers 140 and 142 are connected to the emitters of the phototransistors 86 and 87 while the negative inputs of the amplifiers 140 and 142 are connected by the respective resistances 144 and 146 to the common terminal and by feedback resistances 148 and 150 to the output of the amplifiers 140 and 142. Similarly, operational amplifiers 152 and 154 have their positive inputs connected to the emitters of respective light sensing devices or phototransistors 91 and 92 while their negative inputs are connected by respective resistances 156 and 158 to ground and by direct lines to the outputs of the amplifiers 152 and 154.

The output of the amplifier 140 is applied to a peak detecting and holding circuit 163 which includes a diode 164 serially connected between the output of amplifier 140 and a parallel combination of a capacitance 166 and a resistance 168 to ground. The junction of the capacitance 166 and the diode 164 is connected to the positive input of an operational amplifier 170 which has its negative input connected by resistance 172 to ground and by feedback resistance 174 to the output of amplifier 170. The value of the capacitance 166 and the resistance 168 along with the polarity of the diode 164 are selected to detect the peak voltage pulse from the amplifier 140 and to hold the value of the peak voltage pulse on the capacitor 166 for a relatively long period compared to intervals between sensing particles, for example, for than 10 seconds where the interval between apertures passing the phototransistor 86 is 100 milliseconds, such as to produce a constant output voltage on the output of the operational amplifier 170.

The output of the amplifier 170 and the peak detecting and holding circuit 163 is connected to one input of a threshold circuit 176 connected to a normally closed contact of a single-pole double-throw switch 178 which has its contact arm connected to one end of a potentiometer 180. The normally open contact of switch 178 is connected to voltage terminal +V. The other end of the potentiometer 180 is connected by a diode 182 to ground. An operational amplifier 184 has its negative input connected to the slider of the potentiometer 180 while the positive input of amplifier 184 is connected by a resistance 186 to the output of the operational amplifier 140. A feedback resistance 188 connects the output of the amplifier 184 back to the positive input thereof. Also, the output of the amplifier 184 is connected by a resistance 190 to a parallel combination of a resistance 192 and a voltage limiting diode 194. The junction of resistances 190 and 192 is connected to an input of an inverter 196 which has its output connected to output line 197 of the threshold circuit 176. The position of the slider of the potentiometer 180 is selected to provide a negative output pulse on line 197 when the value of light sensed through an aperture 70 of the conveyer belt 26 has at least a predetermined value with respect to the peak value sensed by the phototransistor 84.

A peak detecting and holding circuit 198 and a threshold circuit 200 substantially identical to the peak detecting and holding circuit 163 and threshold circuit 176 are connected to the output of the operational amplifier 142. The circuit 198 and 200 are similarly designed and set to produce a negative output pulse on line 201 from the threshold circuit 200 when the value of light sensed through an aperture 71 has at least a predetermined value with respect to the peak value sensed by the phototransistor 87.

The output of the amplifier 154 is connected by a resistance 202 to the positive input of an amplifier 204 which has its negative input connected to the slider of a potentiometer 206 having ends connected between the voltage terminal +V and ground. A feedback resistance 208 is connected between the output of the amplifier 204 and its positive input. A resistance 210 connects the output of the amplifier 204 to a parallel resistance 212 and limiting diode 214 to ground. The junction of the resistances 210 and 212 is connected to an inverter and buffer amplifier 216 which has an output connected to line 217.

Similarly, the output of the amplifier 152 is connected by a resistance 218 to the positive input of an amplifier 220 which has its negative input connected to the slider of a potentiometer 222 connected across the voltage terminals +V and −V. A feedback resistance 224 is connected from the output of the amplifier 220 back to the positive input thereof. A resistance 226 connects the output of the amplifier 220 to the cathode of a limiting diode 228 which has its anode connected to ground. The LED 88, phototransistor 91, amplifiers 152 and 220, potentiometer 222, resistors 132, 156 218, 224 and 226, and diode 228 form a timing hole sensing and amplifier circuit 229. The junction of resistance 226 and diode 228 is connected to a line 230.

Figure 6B:
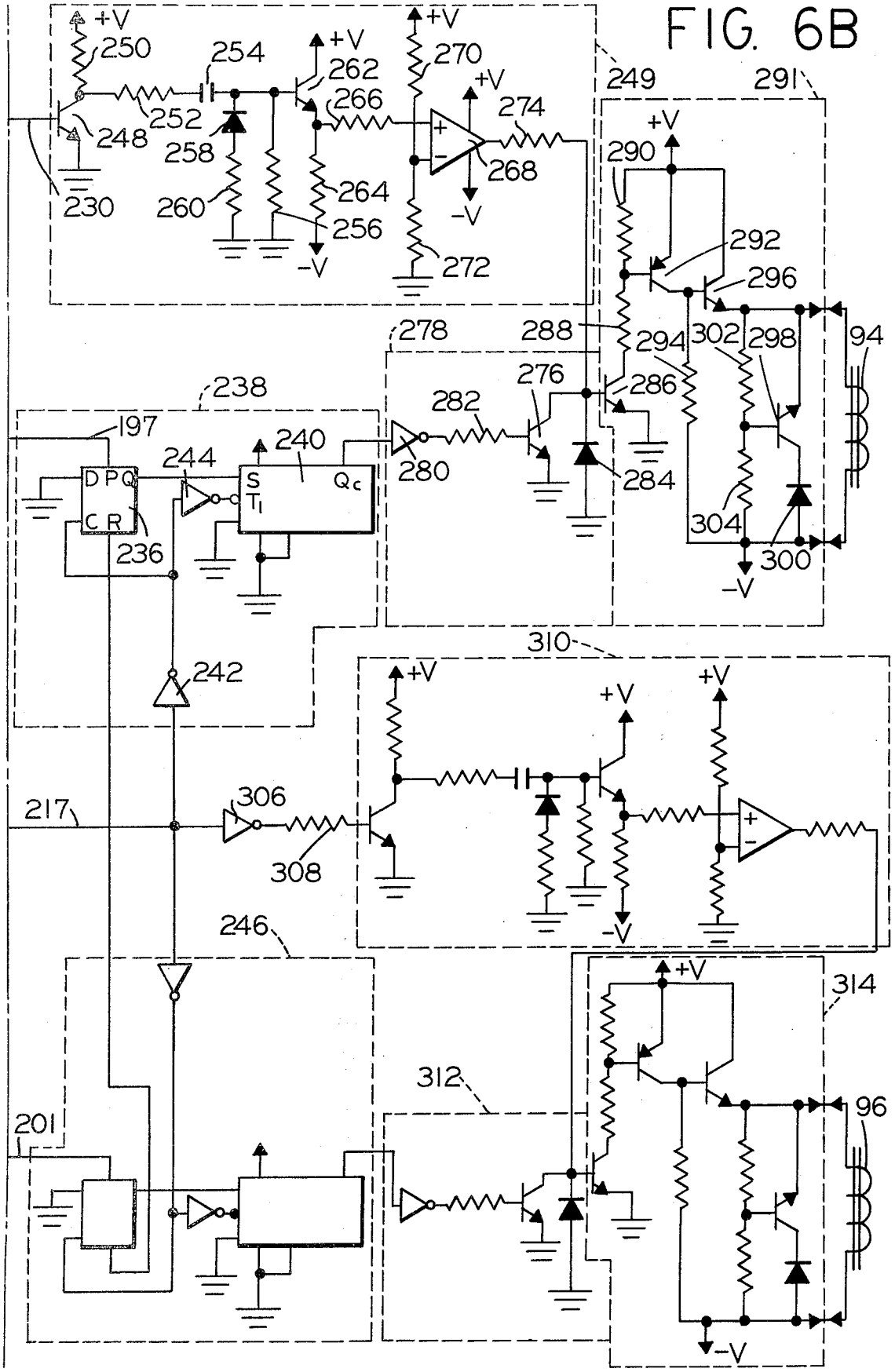
FIG. 6B is the right portion of the circuit diagram for the apparatus shown in FIG. 1.

In FIG. 6B, the output line 197 of the threshold circuit 176 is connected to the present input of a flip-flop 236 in a memory circuit 238. The Q output of the flip-flop 236 is connected to an input of a shift register 240. The line 217 from the output of the inverter amplifier 216 is connected by an inverter 242 to the clock input of the flip-flop 236 which has its data input connected to ground. Also, the output of the inverter 242 is connected by an inverter 244 to a clock input of the shift register 240.

A memory circuit 246 substantially identical to the memory circuit 238 is connected the line 201 and has clock inputs connected to the line 217.

The line 230 is connected to the base electrode of a transistor 248 in a buffer and conditioning circuit 249. The transistor 248 has its emitter electrode connected to ground and its collector electrode connected by a resistance 250 to the voltage terminal +V. A resistance 252 connects the collector electrode of the transistor 248 to a differentiating circuit including a capacitor 254 in series with a resistance 256 to ground. A limiting diode 258 in series with a resistance 260 is connected across the resistance 256. The junction of the capacitor 254 and the resistance 256 is connected to the base of a transistor 262 which has its emitter electrode connected in series with a resistance 264 to the voltage terminal −V. The collector electrode of the transistor 262 is connected to the voltage terminal +V. The junction of the emitter electrode of the transistor 262 and the resistance 264 is connected by a resistance 266 to the positive input of an amplifier 268 which has its negative input connected to a junction of resistors 270 and 272 forming a voltage divider across the voltage terminal +V and ground.

The output of the amplifier 268 is connected by a resistance 274 to an output line of the buffer and conditioning circuit 249 which is connected to the collector electrode of a grounded emitter transistor 276 in an AND circuit 278. The output of the memory circuit 238 from the output of the shift register 240 is connected by an inverter 280 and series resistance 282 to the base electrode of the transistor 276. A diode 284 is connected across the collector and emitter electrodes of the transistor 276.

The output of the AND circuit 278 on the collector electrode of the transistor 276 is connected to the base electrode of a grounded emitter transistor 286 which has its collector electrode connected in series with resistance 288 and 290 in a solenoid drive circuit 291 to the voltage terminal +V. The emitter electrode of a PNP transistor 292 is connected to the voltage terminal +V, the base electrode of the transistor 292 is connected to the junction of resistors 288 and 290, and the collector electrode of transistor 292 is connected in series with a resistance 294 to the voltage −V. An NPN transistor 296 has a base electrode connected to the collector electrode of the transistor 292 and has emitter and collector electrodes connected in series with the solenoid valve 94 across the voltage terminals +V and −V. The solenoid drive circuit 291 has its output terminals protected by a transistor 298 having its emitter and collector electrodes connected in series with a diode 300 across the output terminals wherein the base electrode of the transistor 298 is connected to the junction between resistors 302 and 304 forming a voltage divider across the output of the driver circuit 291.

The line 217 is connected by an inverter 306 and series resistance 308 to a buffer and conditioning circuit 310 which is substantially identical with the buffer and conditioning circuit 249. An AND circuit 312 substantially similar to the AND circuit 278 has inputs connected to the output of the memory 246 and the output of the buffer and conditioning circuit 310 respectively. The output of the AND circuit 312 is connected to a solenoid drive circuit 314 which is substantially similar to the solenoid drive circuit 291 and which is connected to the solenoid valve 96 for operating solenoid valve 96.

In operation of the glass sorting apparatus of FIG. 1, the particles are fed by the feeding station 46 sequentially in two rows into the dimples 74 in the strip 66 of the belt conveyor 26 over the respective apertures 70 and 72 formed through the belt conveyor 26. The belt conveyor 26 then advances the particles beneath the sensing station 48 where the light transmissivity of the particles is sensed by passing a beam of light through the particles and sensing the amount of light which is transmitted therethrough. The output of the sensing station is applied to the electronic circuitry 60 which is operated in synchronism with the apertures 68 to control the separating station 50 for blowing particles of selected color transmissivity from the belt conveyor 26 into the hood 52 and receptacle 54. Articles which are not removed from the belt conveyor 26 at the sorting station 50 are dropped off the end of the belt conveyor 26 into a receptacle 56 for disposal or other use.

More particularly refering to FIGS. 2, 3, and 4, the particles 18 seated in the conical depressions 74 pass beneath the light sources 84 and 85 at the sensing station 48 which pass beams of light therethrough and through apertures 70 and 72 in the belt conveyor 26 to the light sensing devices 86 and 87 when the apertures 70 and 72 are aligned with the apertures 80 and 82. The apertures 70 and 72 operate as windows to limit the area through the particles 18 in which the transmissivity is sensed; such limitation substantially overcomes problems such as retraction, reflection and diffusion of light through irregular shaped particles.

As shown in FIG. 6A the light from the light sources or light emitting diodes 84 and 85 impinging upon the light sensing devices or phototransistors 86 and 87 produce an output voltage across the respective resistances 134 and 138 corresponding to the transmissivity of the particle 18 over the respective apertures 70 and 72. The voltage across resistances 134 and 138 is amplified by the respective amplifiers 140 and 142 and applied to the inputs of the respective peak detecting and holding circuits 163 and 198 and to inputs of the respective threshold circuits 176 and 200.

In the peak detecting and holding circuit 163, the capacitance 166 is charged by current through diode 164 during peak voltge pulses from amplifier 140. The peak voltage pulses occur when an aperture 70 without any particle or a particular color of particle, such as a clear particle, passes over the opening 80, FIGS. 3 and 4. The capacitance 166 retains its charge for a long duration producing a voltge output on amplifier 170 which corresponds to the general ambient light conditions and transmission conditions from the light emitting diodes 84 to the phototransistor 86; for example if dust reduces the transmissivity between light emitting diode 84 and phototransistor 86, over a long duration, the voltage output of amplifier 170 is correspondingly reduced.

In the threshold circuit 176, the position of the slider of the potentiometer 180 determines a selected percentage of the voltage from the peak detecting and holding circuit which is applied to the negative input of amplifier 184. The amplifier 184 only produces a positive output when the voltage from the amplifier 140 is more positive than the voltage from the slider of the potentiometer 180 to produce an indication of a predetermined color transmissivity between the light emitting diode 84 and the phototransistor 86. For example, if the light emitting diode 84 emits light principally of a wavelength of about 0.7 microns and the phototransistor 87 principally responds to light having a wavelength of about 0.7 microns, then clear or flint glass particles transmit about 90% of the light, green glass particles transmit less than 76%, and amber, blue and yellow glass particles transmit less than 50 percent; thus a setting of the potentiometer 180 corresponding to between about 75–90 percent of full transmission, i.e. no particle over aperture 70, produces a negative pulse on line 197 only when a clear glass particle or no particle is over the aperture 70. The negative pulse on line 197 presets the flip flop 236 (FIG. 6B) in the memory 238 to produce a voltage output on the Q output of the flip flop 236.

Similarly the light emitting diode 85 and phototransistor 87 sense color transmissivity through apertures 72 to operate the amplifier 142, the peak detecting and holding circuit 198, and the threshold circuit 200 to produce negative pulses on line 201 which are stored in the memory 246.

When the apertures 68 pass between the light emitting diode 89 and the phototransistor 92, pulses are produced from the output of the amplifier 154 which are amplified by the amplifier 204 and inverted to negative pulses by inverter 216. The position of the light emitting diode 89, the phototransistor 92 and the opening 68 is selected relative to the positions of light emitting diodes 84 and 85, phototransistors 86 and 87, and openings 80 and 82 to produce the negative pulse on line 217 only between the periods that the apertures 70 and 72 are aligned with the openings 80 and 82; for example the pulse on line 217 can be delayed about three milliseconds from pulses on lines 197 and 201. The pulses on line 217 shift the output of the flip flop 236 into the first stage in the shift register 240, shift the data corresponding to previously sensing particles down the shift register 240, and clear the flip flop 236 in preparation for the next sensing of a particle on an aperture 70. Similarly, the memory 246 is operated by the pulses on line 217.

The sensing or timing holes 68 in the belt 26 pass between the light emitting diode 88 and the phototransistor 91 to produce pulses through the amplifiers 152 and 220 and to produce output pulses on line 230. Each output pulse on line 230 is inverted by the transistor 248 and differentiated by the capacitance 254 and resistance 256 to produce a positive spike corresponding to the trailing edge of the pulse from transistor 248. The positive spike from capacitance 254 is suitably shaped and formed by transistor 262 and amplifier 268 and then applied to one input of the AND circuit 278.

If the output of the memory 238 or shift register 240 is positive applying a positive signal to the other input of the AND circuit 278, the transistor 276 is non-conductive to apply a positive pulse to the solenoid driving circuit 291. The transistors 286, 292 and 296 are rendered conductive by the positive signal from the AND circuit 278 to energize the solenoid valve 94. The position of the aperture 68 relative to the aperture 70 and the position of the opening 90 relative to the opening 104 is selected so that the solenoid valve 94 is only operated when the aperture 70 is aligned with the opening 104, FIGS. 2–3.

Similarly the pulses on line 217 are applied by inverter 306 and resistance 308 to the buffer and conditioning circuit 310 to operate the AND circuit 312 and solenoid drive circuit 314.

When one of the solenoid valves 94 and 96 is operated, a jet of air is produced through the respective opening 104 and 106 to pass through the respective aperture 70 and 72 to blow the particle 18 upward from the belt conveyor 26 with sufficient force to be deflected by the plate 108 into the hood 52. Thus glass particles with a selected transmissivity, such as clear glass particles, are separated from other particles not having the selected transmissivity.

It is particularly advantageous that the belt conveyor 26 is provided with the row of longitudinally spaced apertures which cooperate both with the light sensing devices 86 and with the opening 104 from the solenoid air valve. The operation of the light sensing device as well as the air jet is limited to a particular area of the particle producing substantially greater reliability.

Also it is advantageous that the belt conveyor 26 includes a separate row of apertures for timing and synchronization functions. The synchronization of the memory and the air jet by the belt conveyor eliminates problems related to belt elongation, variations in speed, variation in electronic timing constants, and the like.

A modified portion of a sorting apparatus, shown in FIGS. 7, 8, and 9, has parts identified by the same numerals used to identify parts in FIGS. 1–6 to indicate that such parts have substantially similar structure and/or function. A belt conveyor 426 has a base strip 464 and a article supporting strip 466 through which four longitudinal rows of apertures 470, 471, 472 and 473 are formed. The air solenoid valves 94 and 96 have their outputs connected to branched conduits communicating with respective pairs of openings 404, 405, 406 and 407. The pair of openings 404 and 405 are staggered relative to each other along the longitudinal path of the belt conveyor so that one of the openings 404 or 405 is closed by the belt conveyor when the other opening 404 and 405 is aligned with respective aperture 470 and 471. Similarly the openings 406 and 407 are staggered. The electronic control circuitry is modified and supplemented so that operation of both solenoid valves 94 and 96 is enabled when either light sensing device 91 is operated to allow respective memory circuits corresponding to the rows of holes 470 and 471 to operate the valve 94 and to allow respective memory circuit corresponding to the rows of holes 472 and 473 to operate the valve 96. The light sensing devices 91 and 92 are positioned relative to the openings 404, 405, 406 and 407 so that air jets can be passed through openings 404 and 406 only in response to light sensing device 91, and air jets can be passed through openings 405 and 407 only in response to light sensing device 92. Thus each air solenoid valve 94 and 96 can be used for a plurality of rows.

Figure 10:
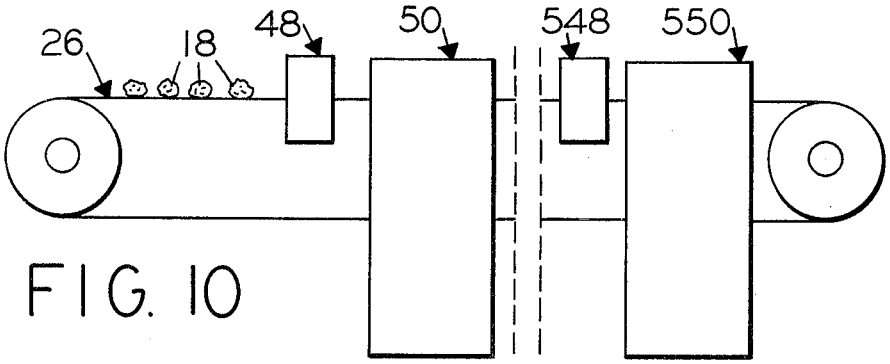
FIG. 10 is a diagram of another variation of the sorting apparatus in accordance with the invention.

A further variation of the sorting apparatus, shown in FIG. 10, has parts identified by numerals used to identify parts in FIG. 1 indicating that such parts are substantially similar in structure and/or function. The sorting apparatus of FIG. 10 includes a sensing station 548 and a separating station 550 in addition to the sensing station 48 and separating station 50. As indicated by the break in the conveyor belt 26, still additional sensing stations and separating stations may be added. The sensing station 48 may be set to sense clear glass and to operate the separating station 50 to remove clear glass from the conveyor 26 at the separating station 50. The sensing station 548 may be set to sense a selected different color transmissivity and to cause the separating station 550 to remove the particles with the selected different color transmissivity. Circuitry similar to circuitry in FIGS. 6A and 6B can operate the separating station 550, except that the threshold circuits 176 and 200 for station 550 are set so that they respond to a lesser transmissivity corresponding to a different color. For example, clear glass transmits about 90 percent of the light, green glass transmits about 60 percent of the light, while amber, blue and yellow glass transmits less than 50 percent of the light, thus with the first sensing station 48 set to respond to light transmissivity of about 90 percent, the sorting station 50 can be set to respond to light transmissivity of about 60 percent, thus green light glass will be removed from the belt conveyor 26 at station 550. Various color filters can be provided for further selecting or improving the selectivity of the separating stations.

Figure 11:
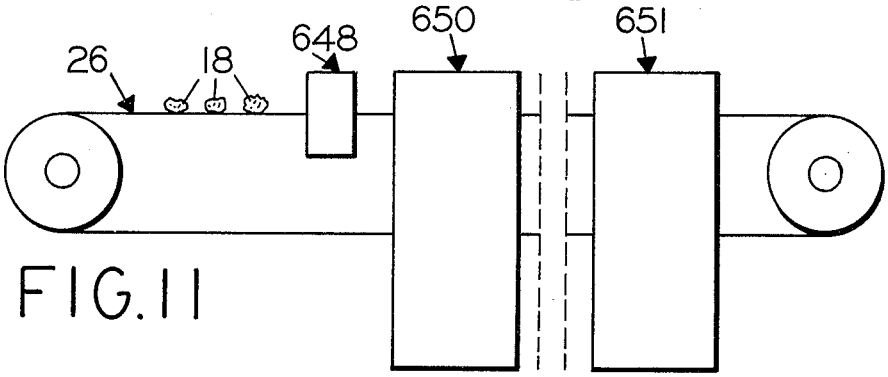
FIG. 11 is a diagram of still another variation of the sorting apparatus in accordance with the invention.
Figure 12:
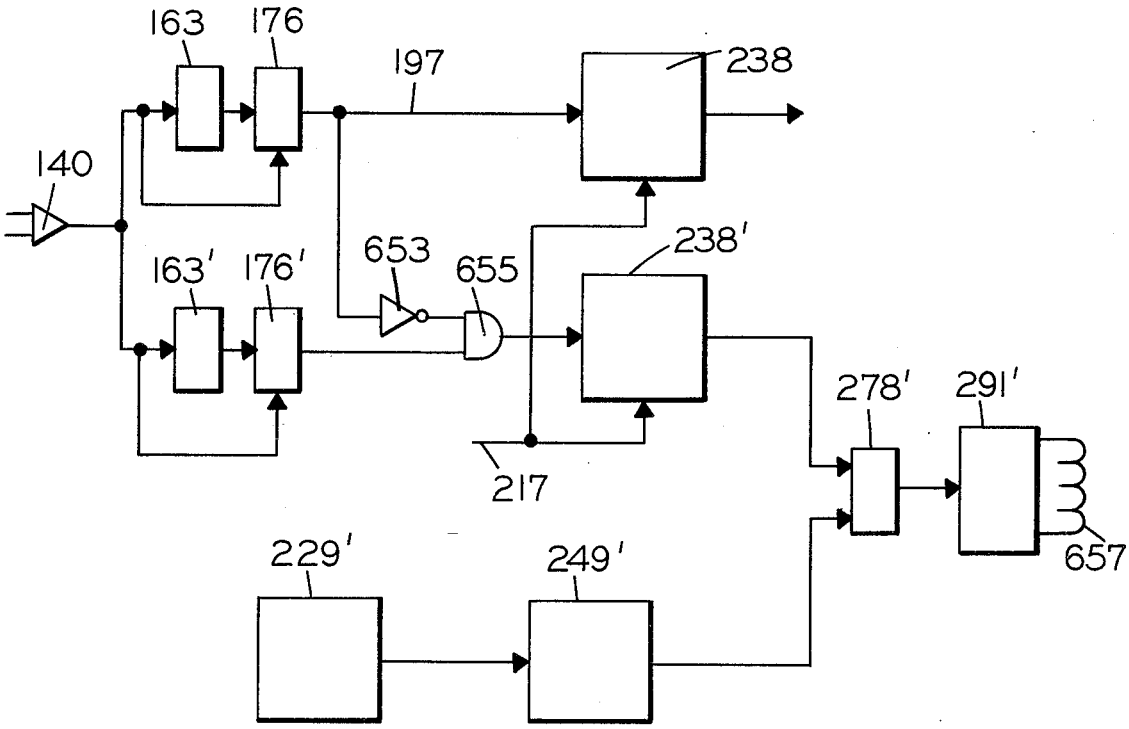
FIG. 12 is a diagram of a circuit for the variation of FIG. 11.

Another variation of the sorting apparatus is illustrated in FIG. 11 wherein a single sensing station 648 operates a plurality of separating stations 650 and 651. The modification of the electronic circuit of FIGS. 6A and 6B necessary to enable the sensing station 648 to operate both sorting stations 650 and 651 is illustrated in FIG. 12 by showing the circuit modifications necessary to sort particles from the row of apertures 70;

substantially similar modifications are made to sort particles from the row of apertures 72. A peak detecting and holding circuit 163' and a threshold circuit 176' are added to the circuitry and connected to the output of the amplifier 140. The output of the threshold circuit 176' is applied to one input of an AND gate 655 while the output of the threshold circuit 176 and 197 is inverted by an inverter 653 and applied to a second input of the AND gate 655. The AND gate 655 will thus produce an output only if the output from threshold circuit 176' is present and there is an absence of an output from threshold circuit 176. The output of the AND gate 655 is applied to a memory 238' which is operated by the pulse on line 217 but has a different length or delay than the memory 238 to correspond to the further distance from the sensing station 648. The output of the memory 238' is applied to the input of an AND gate 278' which also has a second input from a buffer and conditioning circuit 429' operated by a timing hole sensing and amplifying circuit 229'. The output of the AND gate 278' operates a solenoid driving circuit 291' which operates a solenoid valve 657 at the sorting station 651 to sort particles of a different transmissivity, such as green glass particles, from the remaining particles in the row of holes 70 on the belt. The circuits 229', 249', 278' and 291' are similar to the respective circuits 229, 249, 278 and 291 of FIGS. 6A and 6B.

Since many modifications, changes in detail and variations may be made to the presently described embodiments, it is intended that all matter in the foregoing description and accompanying drawings be interpreted as illustrative and not in a limiting sense.

What is claimed is:

1. An apparatus for sorting articles according to transmissivity comprising an opaque belt conveyor having a row of longitudinally spaced apertures and means for receiving the articles such that each article is positioned over one of the apertures, means for moving the belt conveyor, a light source positioned on one side of the belt conveyor for directing a light beam through the apertures as they pass thereby, a light responsive device positioned on the other side of the belt conveyor in alignment with the light source, said light responsive device producing an output voltage indicative of the light impinging thereon, a peak detecting and holding circuit for detecting and holding a peak voltage produced by the light responsive device, means for passing a selected percentage of the peak voltage held by the peak detecting and holding circuit, a threshold circuit responsive to the output voltage from the light responsive device exceeding the passed selected percentage of the peak voltage for producing a signal indicating that an aperture has passed a predetermined light, and separating means operated in response to the threshold circuit for separating articles transmitting the predetermined light from articles not transmitting the predetermined light.

2. An apparatus as claimed in claim 1 wherein the light responsive device is principally responsive to light of about 0.7 microns in wavelength.

3. An apparatus as claimed in claim 2 wherein the selected percentage is in the range of about 75 to 90 percent.

4. An apparatus for sorting clear glass cullet particles comprising a belt conveyor having first and second rows of longitudinally spaced apertures and means for receiving the cullet particles on the conveyor belt so that each particle is positioned over one of the apertures in the first row, means for moving the belt conveyor, a plate mounted immediately beneath the belt conveyor, said plate having a first opening aligned with the first row of apertures, said plate having a second opening aligned with the second row of apertures, said plate having a third opening aligned with the first row of apertures and spaced from the first opening, light source means positioned on one side of the belt conveyor for directing light through the first and second openings, said apertures in said first row having a predetermined position relative to respective apertures in the second row, first and second light sensing means positioned on the other side of the belt conveyor in alignment with the respective first and second openings for sensing light passing through each aperture as each aperture moves past the respective opening, said first light sensing means sensing a predetermined light passing through a cullet particle and an aperture, and air jet means mounted beneath the plate and operated in response to both the first and second light sensing means for directing a jet of air through the third opening when an aperture passing the predetermined light is aligned with the third opening whereby operation of the air jet means is synchronized by the apertures in the second row of apertures.

5. An apparatus as claimed in claim 4 wherein the air jet means is spaced from the first sensing means, and there is included memory means for receiving and storing information from the first light sensing means, and synchronization means for operating the memory means in response to the second sensing means to correspond to the spacing between the first light sensing means and the air jet means.

6. An apparatus as claimed in claim 5 wherein the memory means includes a shift register and the synchronization means advances the information in the shift register from an input to an output thereof.

7. An apparatus for sorting clear glass cullet particles comprising a belt conveyor having first and second rows of longitudinally spaced apertures and means for receiving the cullet particles on the conveyor belt so that each particle is positioned over one of the apertures in the first row, means for moving the belt conveyor, a plate mounted immediately beneath the belt conveyor, said plate having a first opening aligned with the first row of apertures, said plate having a second opening aligned with the second row of apertures, said plate having a third opening aligned with the first row of apertures, light source means positioned on one side of the belt conveyor for directing light through the first and second openings, said apertures in said first row having a predetermined position relative to respective apertures in the second row, first and second light sensing means positioned on the other side of the belt conveyor in alignment with the respective first and second openings for sensing light passing through each aperture as each aperture moves past the respective opening, said first light sensing means sensing a predetermined light passing through a cullet particle and an aperture, air jet means mounted beneath the plate and operated in response to both the first and second light sensing means for directing a jet of air through the third opening when an aperture passing the predetermined light is aligned with the third opening whereby operation of the air jet means is synchronized by the apertures in the second row of apertures, said air jet means being spaced from the first sensing means, memory means for receiving and storing information from the first light sensing means, synchronization means for operating the memory means in response to the second sensing means to correspond to the spacing between the first light sensing means and the air jet means, said memory means including a shift register and said synchronization means advancing the information in the shift register from an input to an output thereof, said memory also including a flip flop connected between the first light sensing means and the shift register for receiving the information from the first light sensing means and for applying the information to the input of the shift register, and said second light sensing means being positioned relative to the first light sensing means so that the synchronization means is operated only between the operations of the first light sensing means.

8. An apparatus for sorting irregular and jagged particles of a selected color transmissivity from other particles comprising an opaque belt conveyor formed from a laminated base strip and cover strip so as to leave a longitudinal strip of uncovered base strip;

said laminated base strip and cover strip having a plurality of longitudinal rows of particle holes formed therethrough and a conical depression formed in the cover strip around each particle hole for seating particles;

said uncovered base strip having a longitudinal row of synchronizing holes which have a predetermined position relative to respective particle holes;

a plurality of light sources positioned over the respective rows of particle holes and synchronizing holes;

a plate beneath the belt conveyor having a plurality of light passing holes aligned with respective rows of particle holes and synchronizing holes, and having a plurality of air passing holes aligned with the respective plurality of rows of particle holes;

said light passing holes aligned with the row of synchronizing holes having a predetermined position relative to the air passing holes;

a plurality of light sensing devices beneath the respective light passing holes and directly aligned with the light passing holes and respective light sources;

a plurality of shift register means having data inputs responsive to respective light sensing devices beneath light passing holes aligned with rows of particle holes and clock inputs responsive to the light sensing devices beneath the light passing holes aligned with the row of synchronizing holes;

a plurality of air solenoid valves, responsive to both respective shift register means and the light sensing device beneath the light passing holes aligned with the row of synchronizing holes, communicating with the respective air passing holes for applying air jets to the particles to blow the particles upward from the belt conveyor; and hood means above the belt conveyor and air passing holes for deflecting and guiding the upward blown particles to a side of the belt conveyor.

* * * * *